United States Patent [19]

Jabs

[11] Patent Number: 5,033,542

[45] Date of Patent: Jul. 23, 1991

[54] SPACER SUPPORTS FOR TUBES OF A MATRIX OF A HEAT EXCHANGER

[75] Inventor: Alfred Jabs, Groebenzell, Fed. Rep. of Germany

[73] Assignees: MTU Motoren-Und Turbinen-Union, Dachauerstr; Munich GmbH, Munich, both of Fed. Rep. of Germany

[21] Appl. No.: 486,138

[22] Filed: Feb. 28, 1990

[30] Foreign Application Priority Data

Feb. 28, 1989 [DE] Fed. Rep. of Germany ..... 3906241

[51] Int. Cl.[5] ..... F28F 9/00

[52] U.S. Cl. ..... 165/162; 165/67; 165/69; 122/510

[58] Field of Search ..... 165/67, 69, 162; 122/510

[56] References Cited

U.S. PATENT DOCUMENTS

| | | | |
|---|---|---|---|
| 2,920,873 | 1/1960 | Schluderbera et al. | 165/162 X |
| 3,837,397 | 9/1974 | Pettigrew | 165/162 |
| 3,941,188 | 3/1976 | Scheidl | 165/162 |
| 3,965,938 | 6/1976 | Baurle et al. | 138/107 |
| 4,080,998 | 3/1978 | Mottola et al. | 138/107 |
| 4,204,570 | 5/1980 | Eisinger | 165/69 |

FOREIGN PATENT DOCUMENTS

| | | | |
|---|---|---|---|
| 105938 | 4/1984 | European Pat. Off. | 165/162 |
| 842494 | 6/1952 | Fed. Rep. of Germany | 165/162 |
| 928716 | 6/1955 | Fed. Rep. of Germany . | |
| 3329202 | 2/1985 | Fed. Rep. of Germany . | |
| 3726058 | 2/1989 | Fed. Rep. of Germany . | |
| 57-104096 | 6/1982 | Japan | 165/69 |
| 826196 | 5/1981 | U.S.S.R. | 165/162 |

*Primary Examiner*—Martin P. Schwadron
*Assistant Examiner*—Allen J. Flanigan
*Attorney, Agent, or Firm*—Ladas & Parry

[57] ABSTRACT

A heat exchanger having a tube matrix formed by a plurality of heat exchange tubes in which a trelliswork consisting of flexible carrier strips is wound on the tubes such that the tubes serve as crossbars of the trelliswork. The trelliswork is supported at its opposite ends to the frame of the heat exchanger via stay bars to provide support against shock forces and to absorb gravitational and flow forces on the tubes.

10 Claims, 2 Drawing Sheets

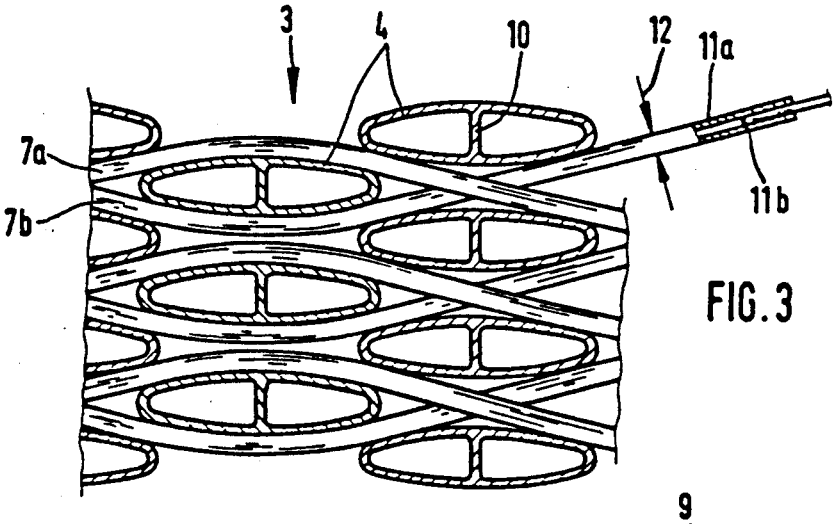
FIG. 3
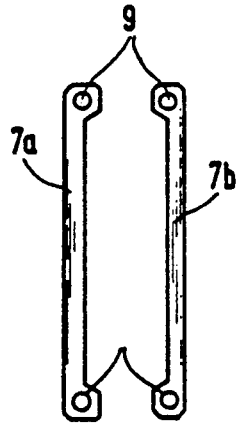
FIG. 2
FIG. 1
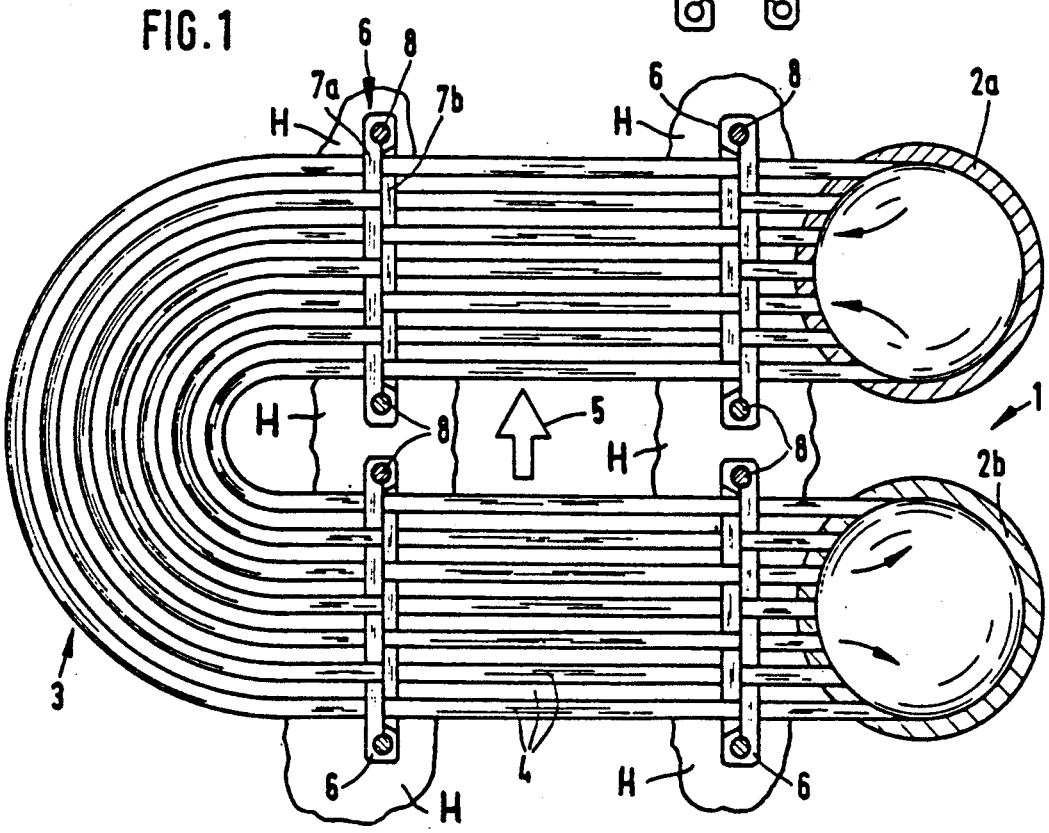

SPACER SUPPORTS FOR TUBES OF A MATRIX OF A HEAT EXCHANGER

FIELD OF THE INVENTION

This invention relates to a heat exchanger having a tube matrix consisting of a plurality of parallel heat exchange tubes and more particularly to spacer supports for the tubes.

DESCRIPTION OF PRIOR ART

Heat exchangers of the above type are disclosed, for example, in DE-OS 33 29 202 and DE-OS 37 26 058. In such heat exchangers, the individual heat exchange tubes are, on the one hand, fixed in position relative to one another to provide constant spacing between the tubes, and on the other hand, the matrix consisting of all of the tubes is supported in a fixed position. Additionally, thermal stresses and thermal displacements caused by large temperature differences must be taken into account and shock loads applied to the heat exchanger and the resulting tube vibrations must be intercepted and damped.

In DE-OS 37 26 058, the spacing between the individual tubes is obtained by means of corrugated drawn strips that are inserted in zig-zag fashion through the heat exchanger matrix enclosing the heat exchange tubes on alternate sides. This arrangement maintains constant tube separation while simultaneously damping shock and vibration forces. A disadvantage of this arrangement is that the forces developed during operation, namely and shock forces, are resisted through the walls of the individual tubes. This arrangement also has the drawback that the gravitational forces and particularly the shock forces are not positively resisted by the spacer strips, but are partly transmitted to the adjacent tubes. In the case of severe shock forces, this can lead to excessive stresses and deformation of the most severely stressed heat exchange tubes.

SUMMARY OF THE INVENTION

It is an object of this invention to provide a spacer system for supporting the heat exchange tubes in which the forces on the tubes are transferred to carrier strips so that the heat exchange tubes do not absorb any additional forces.

A further object of the invention is to provide a spacer system which supports the heat exchange tubes and by which assembly of the spacer system on the tubes is simple.

In accordance with this invention, the system for spacing and supporting the heat exchange tubes comprises a trelliswork consisting of a plurality of flexible carrier strips engaging the tubes such that each tube serves as a crossbar of the trelliswork. This system has the important advantage that the heat exchange tubes are considerably relieved at their connections to the manifolds or ducts. A portion of the weight of the heat exchange tubes is resisted by the connections of the tubes to the manifold (weld or solder joints) and the remainder is distributed through the carrier strips to supporting stay bars.

Another advantage is that each tube, although it is suspended in the carrier strips, can freely undergo change in length and position due to the thermal effects.

In accordance with one embodiment of the invention, the flexible carrier strips are made of metal. This permits the use of the heat exchanger at high operating temperatures, and the production costs can be kept low. Alternatively, other flexible materials are also suitable for the carrier strips, for example, heat-resistant plastics and fiber straps having a highly elastic matrix material.

Preferably, the flat strips are supported on both sides externally of the tube matrix. This permits absorption of shock forces in all directions and thus insures exact positioning of the tube matrix.

In a preferred embodiment of the invention, each column of superimposed heat exchange tubes of the tube matrix has two associated carrier strips running side by side, such that the carrier strips enclose the tubes in a zig-zag fashion and cross between successive tubes. This holds the superimposed tubes between the two connection points of the carrier strips at both sides of the tube matrix, while concurrently maintaining the spacing between the tubes. The spacing of the laterally adjacent tubes is established by the thickness of the carrier strips.

The carrier strips are preferably coated with an anti-friction material to permit thermal expansion with minimal wear of the relatively moving parts. Preferably, antivibration properties are concurrently provided to damp vibrations that are produced during operation, due to shocks or to the flow of gas. To accomplish this, the carrier strips are preferably covered with a metal or a ceramic fabric. It is sufficient if the two main surfaces in contact with the heat exchange tubes are so coated.

In another advantageous embodiment of the invention, the carrier strips are supported on stay bars extending perpendicularly to the tube matrix and fastened to a frame of the heat exchanger, the stay bars being provided on both sides of the tube matrix. Such stay bars are easy to assemble and disassemble and provide for structurally simple support of the tube matrix by the frame of the heat exchanger. The carrier strips are preferably widened at their ends where they engage the stay bars, and are provided with holes in which the stay bars are inserted. Spacers are placed on the stay bars between each of two associated carrier strips, said spacers having a thickness corresponding approximately to the width of the individual tubes. This effectively and beneficially also encloses the outer tubes by the carrier strips.

BRIEF DESCRIPTION OF THE FIGURES OF THE DRAWING

FIG. 1 is an elevational view of a heat exchanger incorporating support means for the heat exchange tubes.

FIG. 2 is a side elevational view of two carrier strips associated with one another.

FIG. 3 is a transverse sectional view on enlarged scale through a portion of the tube matrix.

DETAILED DESCRIPTION OF PREFERRED EMBODIMENTS

Figure 4:
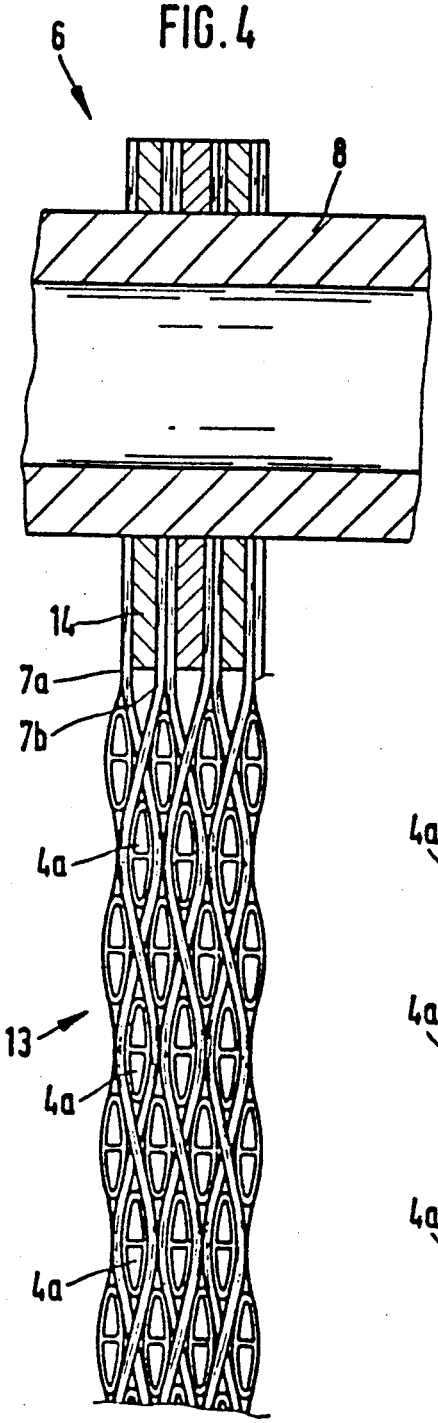
FIG. 4 is a transverse sectional view through a portion of the tube matrix showing the trelliswork support means of the invention with a supporting stay bar.

FIG. 1 diagramatically illustrates a high temperature cross-counterflow heat exchanger 1 comprising parallel manifolds or ducts 21, **2*b*. Connected to the ducts 2*a*, 2*b* is a matrix 3 of U-shaped heat exchange tubes 4. The tubes 4 extend into the path of flow 5** of hot gases. The matrix 3 consists of a large number of the individual tubes 4 which are arranged in rows and columns as shown in FIG. 4, the tubes being of oval cross-section with central reinforcing webs 10 dividing each tube into two flow passages. The hot gas flow 5 travels around the tubes of the matrix and the tubes are arranged with their major axes in the direction of the gas flow. The tubes in successive rows are laterally offset and the tubes of one row are interposed between adjacent tubes of the next row.

In operation, a fluid to be heated is fed to the upper duct 2*a* and flows laterally therefrom into the straight legs of the tubes 4. In the outer bend region of the tube matrix 3, the direction of fluid flow is reversed and the fluid travels through the lower straight legs of the tubes 4 into the lower duct 2*b*. From duct 2*b* the heated fluid flows to a suitable utilization means (not shown), for example, the combustion chamber of a gas turbine engine.

Although FIG. 1 shows tube matrix 3 extending laterally at one side of the ducts 2*a*, 2*b*, it is also possible for a second tube matrix to extend laterally at the opposite sides of the ducts.

A spacer means comprised of spacers 6 are attached to the tube matrix 3 in regularly spaced relation to support the tube matrix and provide for determined spacing of the heat exchange tubes 4 in the matrix. The spacers 6 consist of a number of successively positioned flat carrier strips 7*a*, 7*b*, mounted on stay bars 8 both at their upper and lower ends. The stay bars 8 extend perpendicularly to the tubes 4 and are detachably secured to a frame H of the heat exchanger frame together with the headers 2*a*, 2*b*.

The construction of the carrier strips 7*a*, 7*b* of the spacers 6 is illustrated in detail in FIG. 2. It can be seen here that holes 9 are provided at both ends of the carrier strips 7*a*, 7*b*, that correspond in diameter to the stay bars 8 in FIG. 1. For this purpose, the carrier strips 7*a*, 7*b* are widened in the area of the holes 9. Two carrier strips 7*a*, 7*b* associated with one another, as shown in FIG. 2, are attached opposite one another so that they enclose the individual tubes 4 on opposite sides alternately and in zig-zag fashion, as illustrated schematically in FIG. 1. Namely, each strip is wound in alternation around opposite sides of successive tubes in each column and the strips cross one another between the tubes of the next row.

In the cross section through the tube matrix 3 shown in FIG. 3, individual tubes 4 are shown in cross section. These have elliptical outer contours and are provided with central webs 10 to increase their transverse strength. The tubes 4 of the tubular matrix 3 are also spaced regularly, with the spacing being defined by the flat strips 7*a*, 7*b*. Namely, the thickness of the flat strips 7*a*, 7*b* defines the minimum spacing between adjacent tubes 4. As can also be seen in FIG. 3, each tube 4 is individually enclosed by two associated carrier strips 7*a*, 7*b* which cross one another at opposite ends of the tubes. Thus, the carrier strips 7*a*, 7*b* can be considered as a trelliswork, with the tubes 4 serving as crossbars of the trelliswork. The carrier strips 7*a*, 7*b* are covered on both sides with an antifriction and antivibration layer in the form of fabric layers 11*a*, 11*b* (FIG. 3). Preferably, the two fabric layers 11*a*, 11*b* each represents between 1/5 to ⅓ of the entire thickness 12 of the carrier strips 7*a*, 7*b*.

The trelliswork 13 constituting the spacer 6 is shown in FIG. 4, in which it can be seen how the carrier strips 7*a*, 7*b* are connected to the stay bars 8. A spacer 14 is interposed between associated carrier strips 7*a*, 7*b* for each column of superimposed tubes. The spacer 14 has substantially the same width as the associated tubes 4*a*. This permits the uppermost tubes 4*a* of each column to be wound around by the two associated carrier strips 7*a* and 7*b* on both sides. The trelliswork 13 naturally continues in both directions of extension of the stay bars 8, but this is not shown further here for reasons of clarity. Between successive spacers 14, there are interposed carrier strips 7*a*, 7*b* from successive associated pairs.

Figure 5:
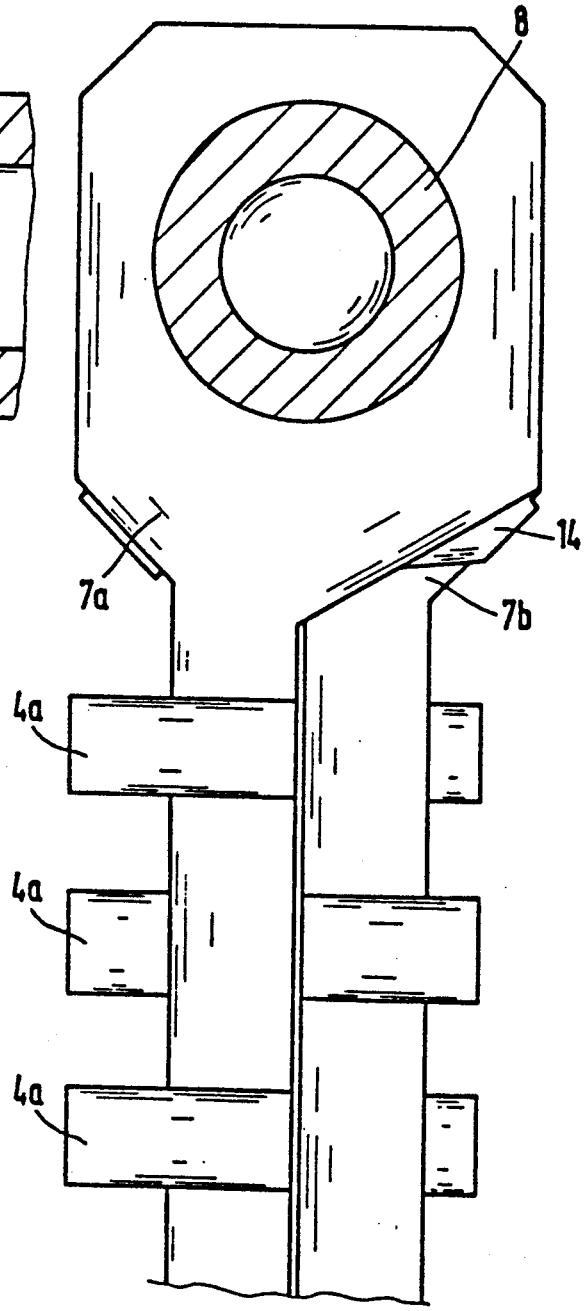
FIG. 5 is a side view of the trelliswork of FIG. 4 with the stay bar in section.

FIG. 5 shows the widening of the carrier strips 7*a*, 7*b* in the area of engagement with the stay bar 8. The carrier strips 7*a*, 7*b* loop around the successively superimposed tubes 4*a* oppositely, so that they cross in the areas between the tubes 4*a* in each case.

Although the invention has been disclosed in relation to specific embodiments thereof, it will become apparent to those skilled in the art that numerous modifications and variations can be made within the scope and spirit of the invention as defined in the attached claims.

What is claimed is:

1. A heat exchanger comprising a tube matrix including a plurality of parallel heat exchange tubes in spaced arrangement in rows and columns, a trelliswork wound on the tubes which serve as crossbars of the trelliswork, said trelliswork comprising flexible carrier strips arranged side by side in pairs for winding on respective columns of tubes, said carrier strips having opposite ends with widened portions, said widened portions having holes, and fixed stay bars engaged in said holes and extending perpendicularly to the tubes of the tube matrix.

2. A heat exchanger as claimed in claim 1 wherein said flexible carrier strips are made of metal.

3. A heat exchanger as claimed in claim 1 wherein the carrier strips in each said pair are wound alternately on opposite sides of the tubes in successive rows thereof and said strips cross one another between said successive rows.

4. A heat exchanger as claimed in claim 3 comprising spacers on said stay bars between each pair of said strips.

5. A heat exchanger as claimed in claim 4 wherein said heat exchange tubes have a width around which said strips are wound, said spacers having a thickness substantially equal to the width of said tubes.

6. A heat exchanger as claimed in claim 5 wherein two strips one from each of two successive pairs of strips, are interposed between successive spacers.

7. A heat exchanger as claimed in claim 1 comprising a frame to which said stay bars are secured.

8. A heat exchanger as claimed in claim 1 comprising a coating of antifriction material on said strips.

9. A heat exchanger as claimed in claim 8 wherein said antifriction material comprises a layer of metal or ceramic fabric.

10. A heat exchanger as claimed in claim 1 wherein said flexible strips are flat.

* * * * *